US012808265B2

(12) United States Patent
Jia et al.

(10) Patent No.: US 12,808,265 B2
(45) Date of Patent: Nov. 24, 2026

(54) PUSH-THE-BIT ROTARY STEERABLE APPARATUS

(71) Applicant: China Oilfield Services Ltd., Binhai New Area Tianjin (CN)

(72) Inventors: Jianbo Jia, Tianjin (CN); Hongbo Lan, Tianjin (CN); Jie Shang, Tianjin (CN); Shixian Sun, Tianjin (CN); Zhijun Jian, Tianjin (CN); Yulin Zhang, Tianjin (CN); Guanqi Zhang, Tianjin (CN); Wei Meng, Tianjin (CN); Weihong Zhu, Tianjin (CN); Xudong Ding, Tianjin (CN); Ling Ji, Tianjin (CN); Hongliang Wang, Tianjin (CN); Hui Li, Tianjin (CN); Xiaojiang Yao, Tianjin (CN)

(73) Assignee: China Oilfield Services Ltd., Tianjing (CN)

( * ) Notice: Subject to any disclaimer, the term of this patent is extended or adjusted under 35 U.S.C. 154(b) by 73 days.

(21) Appl. No.: 18/855,244

(22) PCT Filed: Feb. 14, 2023

(86) PCT No.: PCT/CN2023/075990
§ 371 (c)(1),
(2) Date: Oct. 8, 2024

(87) PCT Pub. No.: WO2023/193522
PCT Pub. Date: Oct. 12, 2023

(65) Prior Publication Data

US 2025/0270880 A1 Aug. 28, 2025

(30) Foreign Application Priority Data

Apr. 8, 2022 (CN) ..... 202210367686.2

(51) Int. Cl.
*E21B 7/06* (2006.01)
*E21B 17/02* (2006.01)
(Continued)

(52) U.S. Cl.
CPC ..... *E21B 7/061* (2013.01); *E21B 7/06* (2013.01); *E21B 47/013* (2020.05); *E21B 47/12* (2013.01); *E21B 7/046* (2013.01); *E21B 17/028* (2013.01)

(58) Field of Classification Search
CPC ..... E21B 7/022; E21B 7/06; E21B 47/013; E21B 47/02; E21B 47/12
See application file for complete search history.

(56) References Cited

U.S. PATENT DOCUMENTS

2019/0234148 A1* 8/2019 Menger ..... E21B 7/06

FOREIGN PATENT DOCUMENTS

CN 107110993 A 8/2017
CN 209277812 U 8/2019
(Continued)

OTHER PUBLICATIONS

International Search Report dated May 18, 2023 for Parent PCT Appl. No. PCT/CN2023/075990.
(Continued)

*Primary Examiner* — Tara Schimpf
*Assistant Examiner* — Lamia Quaim
(74) *Attorney, Agent, or Firm* — James E. Walton

(57) ABSTRACT

The present disclosure relates to a push-the-bit rotary steering device, which includes: an upper driving shaft and a lower driving shaft being coaxially provided and fixedly connected, the upper driving shaft being provided with a circuit control module and a hydraulic push module sequentially on the outer peripheral wall of the upper driving shaft, the lower driving shaft being provided with a gamma
(Continued)

measurement module on the outer peripheral wall, the gamma measurement module being provided with a measurement control circuit and an orientation measurement module electrically connected to the measurement control circuit; and an electrical connection system, which includes an electrical connection component, a communication module and a cable. The measurement control circuit is connected to the electrical connection component, the electrical connection component is connected to the circuit control module, and the circuit control module is connected to the hydraulic push module through the communication module.

20 Claims, 5 Drawing Sheets

(51) Int. Cl.

| | |
|---|---|
| ***E21B 47/013*** | (2012.01) |
| ***E21B 47/12*** | (2012.01) |
| *E21B 7/04* | (2006.01) |

(56) References Cited

FOREIGN PATENT DOCUMENTS

| | | | |
|---|---|---|---|
| CN | 111677445 | A | 9/2020 |
| CN | 114151011 | A | 3/2022 |
| CN | 114658363 | A | 6/2022 |
| EP | 0806542 | A2 | 11/1997 |

OTHER PUBLICATIONS

Written Opinion of the International Searching Authority for Parent PCT Appl. No. PCT/CN2023/0759990.

* cited by examiner

B-B

A-A

PUSH-THE-BIT ROTARY STEERABLE APPARATUS

CROSS REFERENCE TO RELATED APPLICATIONS

The present application is a U.S. National-Stage application under 35 U.S.C, 371 of Int'l Appl. No. PCT/CN2023/075990 filed on 14 Feb. 2023 entitled "Push-the-Bit Rotary Steerable Apparatus", and claims priority to Chinese Patent Application No. 202210367686.2 filed with the China Patent Office on 8 Apr. 2022 entitled "Push-the-Bit Rotary Steerable Apparatus", the entire contents of both of which are incorporated herein by reference for all purposes.

TECHNICAL FIELD

The present disclosure belongs to the technical field of petroleum exploration and development, and specifically relates to a push-the-bit rotary steering device.

BACKGROUND

An existing push-the-bit rotary steering tool mainly consists of an upper driving shaft, a circuit control module, a hydraulic push module and a lower driving shaft and other components. The upper driving shaft is connected to a driving device, the lower driving shaft is provided with a drill bit, and the circuit control module receives an instruction to control the hydraulic push module to provide a magnitude and a direction of a combined force of push forces, so as to enable the rotary steering tool to carry out directional drilling as required.

In the prior art, the push-the-bit rotary steering tool usually suffers from disadvantages in the following aspects when it is specifically used. 1) The push-the-bit rotary steering tool in the prior art usually only has the function of near-drill bit well deviation measurement, and with development of petroleum exploration and development technology, more measurement functions need to be integrated, and due to complexity of the push-the-bit rotary steering tool's own structure, other measurement functions are often integrated into a rotary steering instrument in the prior art, thereby increasing measurement distance, and for geological steering, increasing the measurement distance often leads to occurrence of a situation where the measurement module can only find out after the drill bit has drilled a certain distance out of the reservoir, thus making it impossible to correct the drilling trajectory in a timely manner; 2) The deflecting capacity of the existing rotary steering tool depends mainly on the hydraulic push module, and if the deflecting capacity of the rotary steering tool is to be increased, the combined force of pushing and leaning of the hydraulic push module needs to be increased, and this requires an increase in hydraulic pressure or an increase in piston area, resulting in an increase in the size of the hydraulic system, which is not conducive to the design and application of the rotary steering tool.

SUMMARY

In order to solve all or part of the above problems, it is an object of the present disclosure to provide a push-the-bit rotary steering device to shorten the distance between the gamma measurement point and the drill bit, to solve the difficulties of power supply and communication of the gamma measurement module, and to improve the deflecting capacity of the push-the-bit rotary steering device.

The present disclosure provides a push-the-bit rotary steering device, including: an upper driving shaft and a lower driving shaft, the upper driving shaft and the lower driving shaft being coaxially provided and fixedly connected, the upper driving shaft being configured to be connected with an external driving device, and the lower driving shaft being provided with a drill bit at an end. Wherein the upper driving shaft is provided with a circuit control module and a hydraulic push module sequentially on the outer peripheral wall in a direction close to the lower driving shaft, and the circuit control module is configured to receive a control instruction and control the hydraulic push module to drive the lower driving shaft; the lower driving shaft is provided with a gamma measurement module on the outer peripheral wall of the lower driving shaft, the gamma measurement module being located in a position close to the hydraulic push module, a measurement control circuit and an orientation measurement module electrically connected to the measurement control circuit being provided in the gamma measurement module; and an electrical connection system, including an electrical connection component and two communication modules, the electrical connection component being provided on a connecting end of the upper driving shaft and the lower driving shaft, the two communication modules being provided within the circuit control module and the hydraulic push module respectively; wherein the measurement control circuit is connected to the electrical connection component through a first cable, the electrical connection component is connected to the circuit control module through a second cable, and the circuit control module is connected to the hydraulic push module through the two communication modules.

In some embodiments, the distance between the central measurement point of the gamma measurement module and the drill bit is less than or equal to 1 meter.

In some embodiments, the electrical connection component is configured as an electrical slip ring.

In some embodiments, the electrical slip ring includes an electrical male slip ring and an electrical female slip ring, the electrical male slip ring being provided at an end of the upper driving shaft, and the electrical female slip ring being provided at an end of the lower driving shaft, wherein the electrical connection system further includes a socket connector for connecting the electrical male slip ring and the circuit control module, and the electrical female slip ring is connected to the measurement control circuit through the first cable, and the electrical male slip ring is connected to the circuit control module through the second cable.

In some embodiments, a number of first apertures are formed on an end face of the upper driving shaft, which end face being provided with the electrical male slip ring, the first apertures are configured to run through a wall surface of the upper driving shaft, and the first apertures are configured to house the second cable connecting the electrical male slip ring and the circuit control module.

In some embodiments, a number of second apertures are formed on an end face of the lower driving shaft, which end face being provided with the electrical female slip ring, the second apertures are configured to run through a wall surface of the lower driving shaft, and the second apertures are configured to house the first cable connecting the electrical female slip ring and the measurement control circuit.

In some embodiments, the upper driving shaft is threadedly connected to the lower driving shaft, while the upper driving shaft and the lower driving shaft form a seal by means of the electrical slip ring.

In some embodiments, the push-the-bit rotary steering device further includes a stabilizer structure, the stabilizer structure being provided at a position of the lower driving shaft, which position being close to the drill bit.

In some embodiments, the stabilizer structure includes a plurality of standing walls that are provided spaced apart in an axial direction, each of the standing walls being helically structured along the peripheral wall of the lower driving shaft.

The push-the-bit rotary steering device of the present disclosure has advantages in the following aspects:

1) The push-the-bit rotary steering device of the present disclosure shortens the distance between the gamma measurement module and the drill bit by integrally providing the gamma measurement module on the lower driving shaft, thereby enabling the push-the-bit rotary steering device of the present disclosure to have the function of near-drill bit gamma measurement;
2) The push-the-bit rotary steering device of the present disclosure realizes a wired connection by constructing the electrical connection component as an electrical slip ring, thereby enabling an increase in communication rate of the gamma measurement module, which solves the problems of power supply and communication of the gamma measurement module;
3) The push-the-bit rotary steering device of the present disclosure is provided with a stabilizer structure at a predetermined position of the lower driving shaft, the position being close to the drill bit, which reduces the distance between the stabilizer structure and the drill bit. In this way, it is possible to improve the deflecting capacity of the push-the-bit rotary steering device, so that the push force provided by the hydraulic push module can be appropriately reduced, in order to reduce design difficulty of the hydraulic push module.

DETAILED DESCRIPTION

In order to better understand the purpose, structure and function of the present disclosure, a push-the-bit rotary steering device of the present disclosure will be described in further detail below in conjunction with the accompanying drawings.

Figure 1:
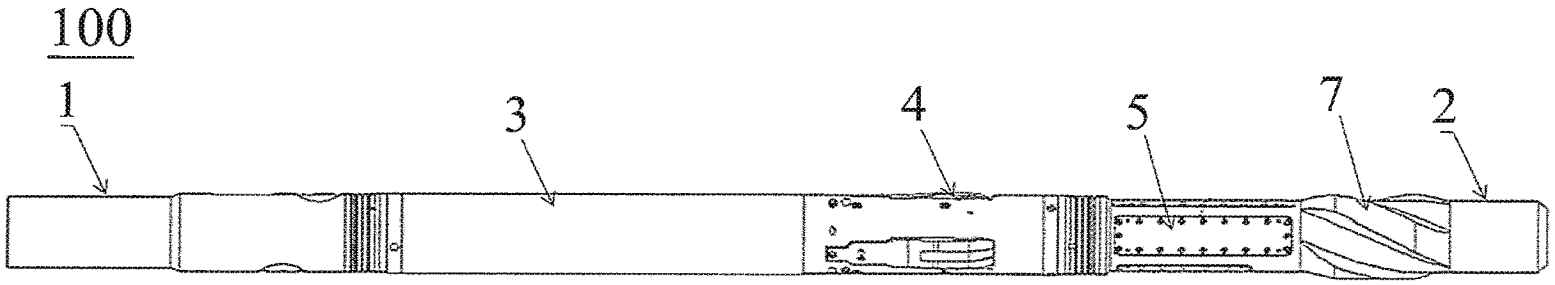
FIG. 1 is a structural schematic diagram of some embodiments of a push-the-bit rotary steering device of an embodiment of the present disclosure.
Figure 2:
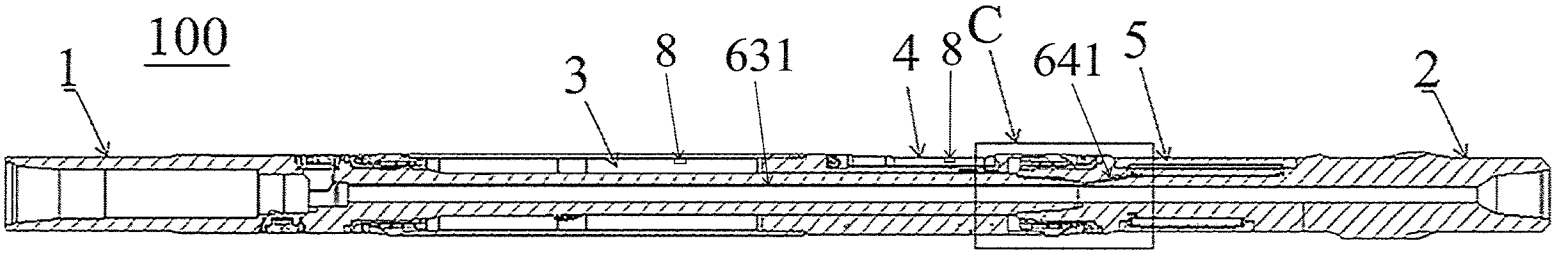
FIG. 2 is a structural sectional view schematic diagram of a push-the-bit rotary steering device of an embodiment of the present disclosure.
Figure 5:
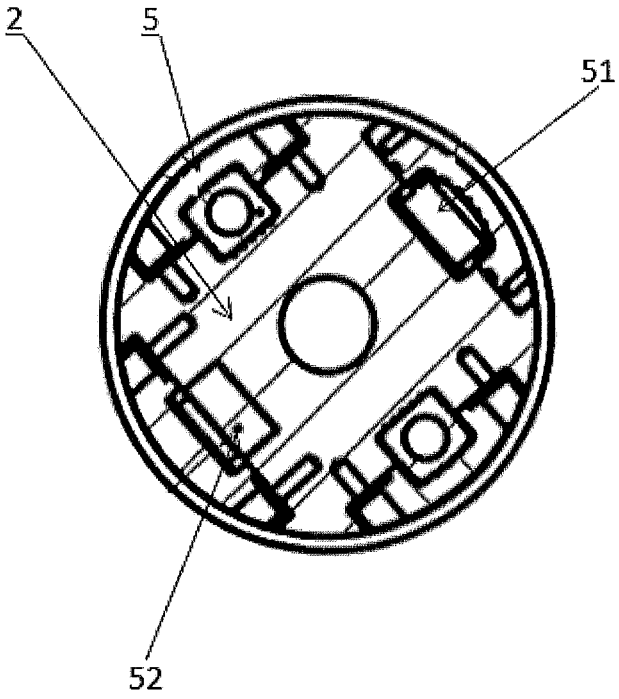
FIG. 5 is a structural schematic diagram of the lower driving shaft shown in FIG. 4 in the direction B-B.

FIG. 1 is a structural schematic diagram of some embodiments of a push-the-bit rotary steering device of an embodiment of the present disclosure, and FIG. 2 is a structural sectional view schematic diagram of some embodiments of a push-the-bit rotary steering device of an embodiment of the present disclosure. As shown in conjunction with FIGS. 1 and 2 as well as FIG. 5, the push-the-bit rotary steering device 100 includes: an upper driving shaft 1 and a lower driving shaft 2, the upper driving shaft 1 and the lower driving shaft 2 being coaxially provided and fixedly connected, the upper driving shaft 1 being configured to be connected with an external driving device, and the lower driving shaft 2 being provided with a drill bit at an end, wherein the upper driving shaft 1 is provided with a circuit control module 3 and a hydraulic push module 4 sequentially on the outer peripheral wall of the upper driving shaft 1 in a direction close to the lower driving shaft 2, and the circuit control module 3 is configured to receive a control instruction, and the circuit control module 3 is configured to control the hydraulic push module 4 to drive the lower driving shaft 2, and the lower driving shaft 2 is provided with a gamma measurement module 5 on the outer peripheral wall of the lower driving shaft 2 in a position close to the hydraulic push module 4, a measurement control circuit 51 and an orientation measurement module 52 electrically connected to the measurement control circuit 51 being provided in the gamma measurement module 5; and an electrical connection system, which includes an electrical connection component 6 and a communication module 8, the electrical connection component 6 being provided on a connecting end of the upper driving shaft 1 and the lower driving shaft 2, the communication module 8 being provided within the circuit control module 3 and the hydraulic push module 4, wherein the measurement control circuit 51 is connected to the electrical connection component 6 through a cable 641, the electrical connection component 6 is connected to the circuit control module 3 through a cable 631, and the circuit control module 3 is connected to the hydraulic push module 4 through the communication modules 8.

In the prior art, it is sometimes necessary to realize a gamma measurement function on a push-the-bit rotary steering tool to meet specific use requirements of a customer. The way to realize this function is usually to integrate the gamma measurement module into the while-drilling instrument. Although this method makes the push-the-bit rotary steering tool have the function of gamma measurement, in actual use, the measurement point of the gamma measurement module integrated into the while-drilling instrument is too far away from the bottom of the well, and it often happens that the push-the-bit rotary steering tool drills out of the reservoir, but the measurement data has still not been displayed, which is not conducive to timely adjustment of the trajectory of the push-the-bit rotary steering tool. If the gamma measurement module is installed in a position close to the drill bit, not only it require changes in arrangement and structure of the circuit control module, the hydraulic push module and the lower driving shaft, but also the relative rotation of the upper driving shaft and the hydraulic push module becomes a difficult point for data transmission, thus increasing the difficulty of arranging the gamma measurement module close to the drill bit. Therefore, how to arrange the gamma measurement module close to the drill bit, increase the communication rate of the gamma measurement module, and solve the difficulties of power supply and communication of the gamma measurement module is a challenging problem that needs to be solved urgently by the skilled person in the art.

In the push-the-bit rotary steering device 100 of the embodiment of the present disclosure, by integrally providing the gamma measurement module 5 above the lower driving shaft 2 and the electrical connection system being able to connect the measurement control circuit 51 to the electrical connection component 6 through the cable 641, the electrical connection component 6 is connected to the circuit control module 3 through the cable 631, and the circuit control module 3 is connected to the hydraulic push module 4 through the communication modules 8. In this way, the push-the-bit rotary steering device 100 of the present disclosure is enabled to shorten the distance between the gamma measurement module 5 and the drill bit 2 by integrally providing the gamma measurement module 5 above the lower driving shaft, thereby enabling the push-the-bit rotary steering device 100 of the present disclosure to have the function of near-drill bit gamma measurement, and for geological guidance, shortening the distance for gamma measurement can facilitate timely correction of the trajectory of the drilling. In addition, the push-the-bit rotary steering device 100 of the present disclosure realizes a wired connection via the electrical connection component 6, thereby enabling an increase in communication rate of the gamma measurement module 5, which solves the problems of power supply and communication of the gamma measurement module 5.

In the specific use of the push-the-bit rotary steering device 100 of the embodiment of the present disclosure, the circuit control module 3 on the upper driving shaft 1 is electrically connected to the external instrument through a cable. Because the upper driving shaft 1 and the hydraulic push module 4 will rotate relative to each other, in the present disclosure, the circuit control module 3 and the hydraulic push module 4 will perform wireless transmission through the communication modules 8, so that wireless transmission of electrical energy and signals can be realized. Further, the measurement control circuit 51 is connected to the electrical connection component 6 through the cable 641, the electrical connection component 6 is connected to the circuit control module 3 through the cable 631, and finally the circuit control module 3 is connected externally to the external instrument.

Figure 4:
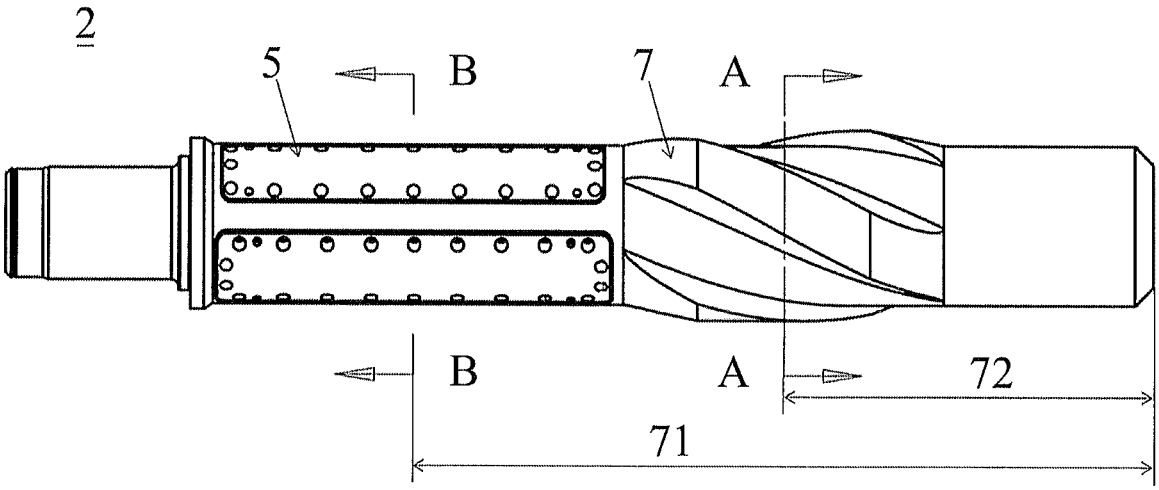
FIG. 4 is a structural schematic diagram of some embodiments of the lower driving shaft shown in FIG. 1.

Referring to FIG. 4, in some embodiments, the distance 71 between the center measurement point of the gamma measurement module 5 and the drill bit is less than or equal to 1 meter to enable the push-the-bit rotary steering device 100 of the embodiment of the present disclosure to further reduce the distance between the gamma measurement module 5 and the drill bit, so that the measurement accuracy and the feedback efficiency of the gamma measurement module 5 can be improved.

Figure 3:
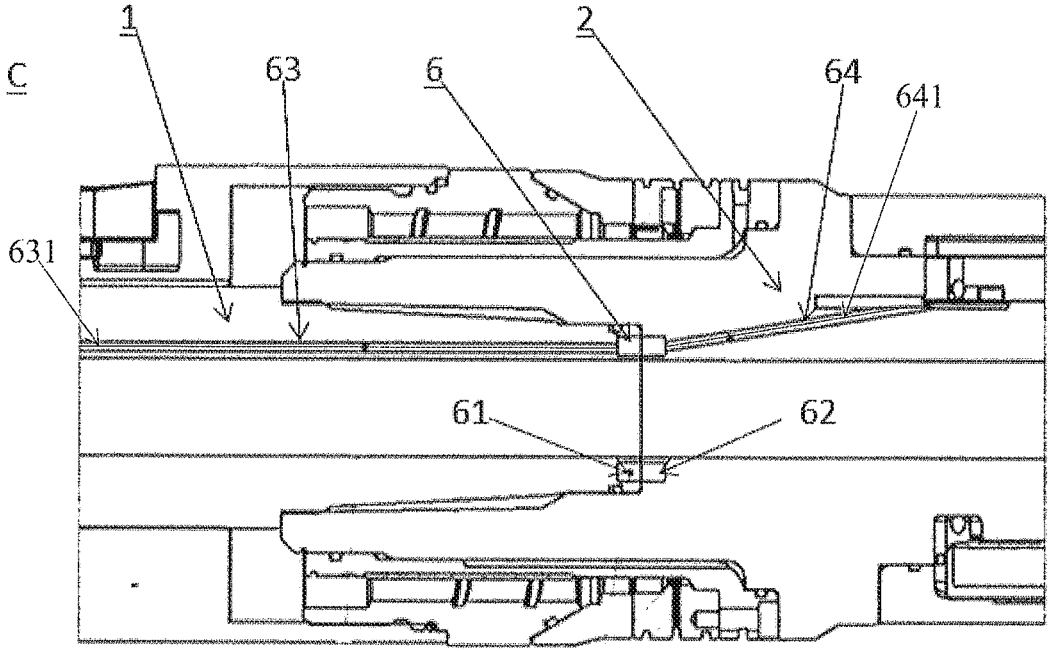
FIG. 3 is an enlarged schematic view at C of the push-the-bit rotary steering device shown in FIG. 2.

Referring to FIG. 3, in some embodiments, the electrical connection component 6 may be configured as an electrical slip ring, and the electrical slip ring may include an electrical male slip ring 61 and an electrical female slip ring 62, the electrical male slip ring 61 being provided at an end of the upper driving shaft 1 and the electrical female slip ring 62 being provided at an end of the lower driving shaft 2. The electrical connection system may further include a socket connector (not shown in the drawings) for connecting the electrical male slip ring 61 and the circuit control module 3. The electrical female slip ring 62 may be connected to the measurement control circuit 51 through the cable 641. In the present disclosure, by constructing the electrical connection component 6 as an electrical slip ring, transmission of electrical energy and signals of the gamma measurement module 5 of the push-the-bit rotary steering device 100 of the embodiment of the present disclosure can be made more stable and more reliable.

Continuing to refer to FIG. 3, in some embodiments, a number of first apertures 63, which run through a wall surface of the upper driving shaft 1, may be formed on an end face of the upper driving shaft 1, the end face being provided with the electrical male slip ring 61, and the first apertures 63 are configured to house the cable 631 connecting the electrical male slip ring 61 and the circuit control module 3; a number of second apertures 64, which run through a wall surface of the lower driving shaft 2, are formed on an end face of the lower driving shaft 2, the end face being provided with the electrical female slip ring 62, and the second apertures 64 are configured to house the cable 641 connecting the electrical female slip ring 62 and the measurement control circuit 51. By this arrangement, the way the cable runs inside the wall surface can make the push-the-bit rotary steering device 100 of the embodiment of the present disclosure, after the upper driving shaft 1 and the lower driving shaft 2 are connected, be able to effectively avoid the interference of the external impurities on the respective electrical members, so as to make wiring connection of the respective electrical members more reliable and the integrality of the push-the-bit rotary steering device 100 better.

In some embodiments, the upper driving shaft 1 is threadedly connected to the lower driving shaft 2, the electrical male slip ring 61 is sealingly provided on the end face of the upper driving shaft 1, the electrical female slip ring 62 is sealingly provided on the end face of the lower driving shaft 2, and the upper driving shaft 1 and the lower driving shaft 2 form a sealing connection through the electrical slip ring.

Referring to FIGS. 1 and 2 as well as FIG. 4, in some embodiments, the push-the-bit rotary steering device 100 further includes a stabilizer structure 7, the stabilizer structure 7 being provided at a predetermined position of the lower driving shaft 2, the predetermined position being close to the drill bit.

In the prior art, if there is a need to increase the deflecting capacity of the push-the-bit rotary steering tool, it is often done by increasing the push force provided by the hydraulic push module. However, the magnitude of the push force of the hydraulic push module is directly related to the pressure and the piston area, which is difficult to change when the structure of the push-the-bit rotary steering tool is finalized.

The push-the-bit rotary steering device 100 of the embodiment of the present disclosure is provided with the stabilizer structure 7 at a predetermined position of the lower driving shaft close to the drill bit, reducing the distance 72 between the stabilizer structure 7 and the drill bit. As can be known through simulation and calculation, the closer the stabilizer structure 7 is to the drill bit, the deflecting is able to improve the deflecting capacity of the push-the-bit rotary steering device 100 of the embodiment of the present disclosure, so that the push force provided by the hydraulic push module 4 can be appropriately reduced in order to reduce the difficulty in the design of the hydraulic push module 4.

Figure 6:
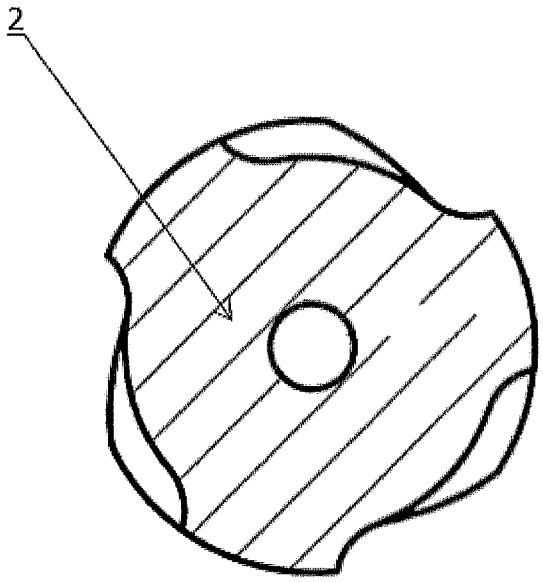
FIG. 6 is a structural schematic diagram of the lower driving shaft shown in FIG. 4 in the direction A-A.

Referring to FIGS. 4 and 6, in some embodiments, the distance 72 of the center of the stabilizer structure 7 to the drill bit in the axial direction ranges from 350 mm to 450 mm. preferably 400 mm. In some embodiments, the distance of the end of the stabilizer structure 7 facing the drill bit to the drill bit ranges from 200 cm to 300 mm. In some embodiments, the outer diameter dimension of the stabilizer structure 7 ranges from 200 cm to 300 mm, and the length dimension of the stabilizer structure 7 in the axial direction ranges from 300 cm to 400 mm.

In the present disclosure, the stabilizer structure 7 is provided close to the drill bit to improve the deflecting capacity of the push-the-bit rotary steering device 100 of the embodiment of the present disclosure, as can be seen from the results of the simulation and calculation comparing with the prior art in the following tables, in which:

TABLE I

| (0° Angle of Hole Deviation) | | | | |
|---|---|---|---|---|
| Type | Push Force Applied by the Tool | Push Force of the Drill Bit | Turning of the Drill Bit (rad) | Drilling Trend Angle (rad) |
| The Prior Art | 14250N | 10588.3N | −0.00119871 | 0.005554032 |
| The Embodiment of the Present Disclosure | 14250N | 38977.9N | 0.0017360 | 0.30561881 |

TABLE II

| (45° Angle of Hole Deviation) | | | | |
|---|---|---|---|---|
| Type | Push Force Applied by the Tool | Push Force of the Drill Bit | Turning of the Drill Bit (rad) | Drilling Trend Angle (rad) |
| The Prior Art | 14250N | 12843.2N | −0.00081341 | 0.007377403 |
| The Embodiment of the Present Disclosure | 14250N | 51155.2N | 0.00173368 | 0.03435817 |

TABLE III

| (90° Angle of Hole Deviation) | | | | |
|---|---|---|---|---|
| Type | Push Force Applied by the Tool | Push Force of the Drill Bit | Turning of the Drill Bit (rad) | Drilling Trend Angle (rad) |
| The Prior Art | 14250N | 11608.2N | −0.00105971 | 0.006343479 |
| The Embodiment of the Present Disclosure | 14250N | 62030.8N | 0.00178292 | 0.041343409 |

As can be known in connection with Tables I, II, and III above, in the case of the same push force applied by the tool, in the push-the-bit rotary steering device 100 of the embodiment of the present disclosure, the stabilizer structure 7 is provided close to the drill bit, so that the actual push force of the drill bit and the drilling trend angle both can be effectively increased.

TABLE IV

| (0° Angle of Hole Deviation) | | |
|---|---|---|
| Type | Push Force Obtained by the Drill Bit | Push Force Output by the Tool |
| The Prior Art | 29400N | 39000N |
| The Embodiment of the Present Disclosure | 29400N | 8800N |

TABLE V

| (45° Angle of Hole Deviation) | | |
|---|---|---|
| Type | Push Force Obtained by the Drill Bit | Push Force Output by the Tool |
| The Prior Art | 29400N | 54000N |
| The Embodiment of the Present Disclosure | 29400N | 5250N |

TABLE VI

| (90° Angle of Hole Deviation) | | |
|---|---|---|
| Type | Push Force Obtained by the Drill Bit | Push Force Output by the Tool |
| The Prior Art | 29400N | 37800N |
| The Embodiment of the Present Disclosure | 29400N | 1860N |

As can be known in connection with Tables IV, V, and VI above, in the case of the same push force obtained by the drill bit, in the push-the-bit rotary steering device 100 of the embodiment of the present disclosure, the stabilizer structure 7 is provided close to the drill bit, so that the output force is significantly reduced, which leads to a further increase in the lifespan of the push-the-bit rotary steering device 100 of the embodiment of the present disclosure.

Referring to FIG. 4 and FIG. 6, in some embodiments, the stabilizer structure 7 may include a plurality of standing walls that are provided spaced apart in an axial direction, and the respective standing walls are helically structured along the peripheral wall of the lower driving shaft 2. Through this arrangement, the stabilizer structure 7 that is helically structured can better fit the well wall during the use of the push-the-bit rotary steering device 100 of the embodiment of the present disclosure, improving the stability of the push-the-bit rotary steering device 100 of the embodiment of the present disclosure when it is in use.

It is to be noted that, unless otherwise indicated, technical or scientific terms used in the present disclosure should have the ordinary meaning as understood by a person skilled in the art to which the present disclosure belongs.

In the description of the present disclosure, it is to be understood that the orientation or positional relationship indicated by the terms "center", "longitudinal", "lateral", "length", "width", "thickness", "upper", "lower", "front", "back", "left", "right", "vertical", "horizontal", "top", "bottom", "inside", "outside", "clockwise", "counterclockwise", "axial", "radial", "circumferential", and so on, is based on the orientation or positional relationship shown in the accompanying drawings, and is intended only to facilitate the description of the present disclosure and to simplify the description, not to indicate or imply that the device or element referred to must have a particular orientation, be constructed and operated in a particular orientation, and therefore is not to be construed as a limitation of the present disclosure.

Furthermore, the terms "first", "second", and so on are intended only for descriptive purposes and are not to be understood as indicating or implying relative importance or implicitly specifying the number of the technical features indicated. In the description of the present disclosure, "a plurality of" means more than two, unless otherwise expressly and specifically limited.

In the present disclosure, unless otherwise expressly specified and limited, the terms "mounted", "connected", "coupled", "fixed", and the like are to be understood broadly, e.g., they may be fixed connection, or may also be removable connection, or may be integral; they may be a mechanical connection or may also be an electrical connection; they may be a direct connection or may also be indirect connection through an intermediate medium, and they may be a communication within two elements or an interactive relationship between two elements. For those of ordinary skill in the art, the specific meanings of the above terms in the present disclosure may be understood on a case-by-case basis.

Finally, it should be noted that the above embodiments are intended only to illustrate the technical solutions of the present disclosure and are not a limitation thereof. Although the present disclosure has been described in detail with reference to the foregoing embodiments, those of ordinary skill in the art should understand that it is still possible to modify the technical solutions disclosed in the foregoing embodiments or to make equivalent substitutions for some or all of the technical features therein; and these modifications or substitutions do not take the essence of the corresponding technical solutions out of the scope of the technical solutions of the embodiments of the present disclosure, which shall be covered by the scope of the claims and the specification of the present disclosure. In particular, the respective technical features mentioned in the respective embodiments can be combined in any way as long as there is no structural conflict. The present disclosure is not limited to the particular embodiments disclosed in the text, but includes all technical solutions falling within the scope of the claims.

What is claimed is:

1. A push-the-bit rotary steering device, comprising:

an upper driving shaft and a lower driving shaft, the upper driving shaft and the lower driving shaft being coaxially provided and fixedly connected, the upper driving shaft being configured to be connected with an external driving device, and the lower driving shaft being provided with a drill bit at an end, wherein the upper driving shaft is provided with a circuit control module and a hydraulic push module sequentially on an outer peripheral wall of the upper driving shaft in a direction close to the lower driving shaft, and the circuit control module is configured to receive a control instruction and control the hydraulic push module to drive the lower driving shaft; an outer peripheral wall of the lower driving shaft is provided with a gamma measurement module, the gamma measurement module being located in a position close to the hydraulic push module, a measurement control circuit and an orientation measurement module electrically connected to the measurement control circuit being provided in the gamma measurement module; and an electrical connection system comprising an electrical connection component and two communication modules, the electrical connection component being provided on a connecting end of the upper driving shaft and the lower driving shaft, the two communication modules being provided within the circuit control module and the hydraulic push module respectively;

wherein the measurement control circuit is connected to the electrical connection component through a first cable, the electrical connection component is connected to the circuit control module through a second cable, and the circuit control module is connected to the hydraulic push module through the two communication modules.

2. The push-the-bit rotary steering device according to claim 1, characterized in that the distance between the central measurement point of the gamma measurement module and the drill bit is less than or equal to 1 meter.

3. The push-the-bit rotary steering device according to claim 1, characterized in that the electrical connection component is configured as an electrical slip ring.

4. The push-the-bit rotary steering device according to claim 3, characterized in that the electrical slip ring comprises an electrical male slip ring and an electrical female slip ring, the electrical male slip ring being provided at an end of the upper driving shaft, and the electrical female slip ring being provided at an end of the lower driving shaft, wherein the electrical connection system further comprises a socket connector for connecting the electrical male slip ring and the circuit control module, the electrical female slip ring is connected to the measurement control circuit through the first cable, and the electrical male slip ring is connected to the circuit control module through the second cable.

5. The push-the-bit rotary steering device according to claim 4, characterized in that a number of first apertures are formed on an end face of the upper driving shaft, the end face of the upper driving shaft being provided with the electrical male slip ring, the first apertures are configured to run through a wall surface of the upper driving shaft, and the first apertures are configured to house the second cable connecting the electrical male slip ring and the circuit control module.

6. The push-the-bit rotary steering device according to claim 5, characterized in that a number of second apertures are formed on an end face of the lower driving shaft, the end face of the lower driving shaft being provided with the electrical female slip ring, the second apertures are configured to run through a wall surface of the lower driving shaft, and the second apertures are configured to house the first cable connecting the electrical female slip ring and the measurement control circuit.

7. The push-the-bit rotary steering device according to claim 6, characterized in that the upper driving shaft is threadedly connected to the lower driving shaft, and the upper driving shaft and the lower driving shaft form a seal by means of the electrical slip ring.

8. The push-the-bit rotary steering device according to claim 1, characterized by further comprising a stabilizer structure, the stabilizer structure being provided at a position of the lower driving shaft that is close to the drill bit.

9. The push-the-bit rotary steering device according to claim 2, characterized by further comprising a stabilizer structure, the stabilizer structure being provided at a position of the lower driving shaft that is close to the drill bit.

10. The push-the-bit rotary steering device according to claim 3, characterized by further comprising a stabilizer structure, the stabilizer structure being provided at a position of the lower driving shaft that is close to the drill bit.

11. The push-the-bit rotary steering device according to claim 4, characterized by further comprising a stabilizer structure, the stabilizer structure being provided at a position of the lower driving shaft that is close to the drill bit.

12. The push-the-bit rotary steering device according to claim 5, characterized by further comprising a stabilizer structure, the stabilizer structure being provided at a position of the lower driving shaft that is close to the drill bit.

13. The push-the-bit rotary steering device according to claim 6, characterized by further comprising a stabilizer structure, the stabilizer structure being provided at a position of the lower driving shaft that is close to the drill bit.

14. The push-the-bit rotary steering device according to claim 7, characterized by further comprising a stabilizer structure, the stabilizer structure being provided at a position of the lower driving shaft that is close to the drill bit.

15. The push-the-bit rotary steering device according to claim 8, characterized in that the stabilizer structure comprises a plurality of standing walls that are provided spaced apart in an axial direction, the standing walls being helically structured along the peripheral wall of the lower driving shaft.

16. The push-the-bit rotary steering device according to claim 9, characterized in that the stabilizer structure comprises a plurality of standing walls that are provided spaced apart in an axial direction, the standing walls being helically structured along the peripheral wall of the lower driving shaft.

17. The push-the-bit rotary steering device according to claim 10, characterized in that the stabilizer structure comprises a plurality of standing walls that are provided spaced apart in an axial direction, the standing walls being helically structured along the peripheral wall of the lower driving shaft.

18. The push-the-bit rotary steering device according to claim 11, characterized in that the stabilizer structure comprises a plurality of standing walls that are provided spaced apart in an axial direction, the standing walls being helically structured along the peripheral wall of the lower driving shaft.

19. The push-the-bit rotary steering device according to claim 12, characterized in that the stabilizer structure comprises a plurality of standing walls that are provided spaced apart in an axial direction, the standing walls being helically structured along the peripheral wall of the lower driving shaft.

20. The push-the-bit rotary steering device according to claim 13, characterized in that the stabilizer structure comprises a plurality of standing walls that are provided spaced apart in an axial direction, the standing walls being helically structured along the peripheral wall of the lower driving shaft.

* * * * *